United States Patent [19]

Gates

[11] Patent Number: 4,740,223

[45] Date of Patent: Apr. 26, 1988

[54] GAS LIQUEFACTION METHOD AND APPARATUS

[75] Inventor: Robert G. Gates, Mendham, N.J.

[73] Assignee: The BOC Group, Inc., Montvale, N.J.

[21] Appl. No.: 926,278

[22] Filed: Nov. 3, 1986

[51] Int. Cl.[4] ..... F25J 3/06

[52] U.S. Cl. ..... 62/23; 62/38; 62/40

[58] Field of Search ..... 62/9, 11, 23, 38, 40

[56] References Cited

U.S. PATENT DOCUMENTS

| | | | |
|---|---|---|---|
| 3,416,324 | 12/1968 | Swearingen | 62/38 |
| 3,508,413 | 4/1970 | Pryor | 62/40 |
| 3,596,473 | 8/1971 | Streich | 62/40 |
| 3,616,652 | 11/1971 | Engel | 62/38 |
| 3,677,019 | 7/1972 | Olszewski | 62/9 |
| 4,608,067 | 8/1986 | Marshall | 62/9 |
| 4,638,638 | 1/1987 | Marshall | 62/9 |
| 4,638,639 | 1/1987 | Marshall | 62/9 |

*Primary Examiner*—Ronald C. Capossela

*Attorney, Agent, or Firm*—R. Hain Swope; Larry R. Cassett

[57] ABSTRACT

The present invention relates to the liquefaction of a permanent gas comprising nitrogen. The temperature of the permanent gas stream at a pressure in the range of 75 to 90 atmospheres is reduced to below its initial temperature. Providing at least part of the necessary refrigeration, a single nitrogen working fluid cycle is performed in which the nitrogen working fluid is compressed to a pressure in the range of 75 to 90 atmospheres, cooled to a temperature in the range of 170 to 200 K., work expanded to a temperature in the range of 107 to 120 K., and warmed by heat exchange countercurrently to the permanent gas stream, thereby providing refrigeration for the stream.

11 Claims, 2 Drawing Sheets

GAS LIQUEFACTION METHOD AND APPARATUS

DESCRIPTION

Figure 1:
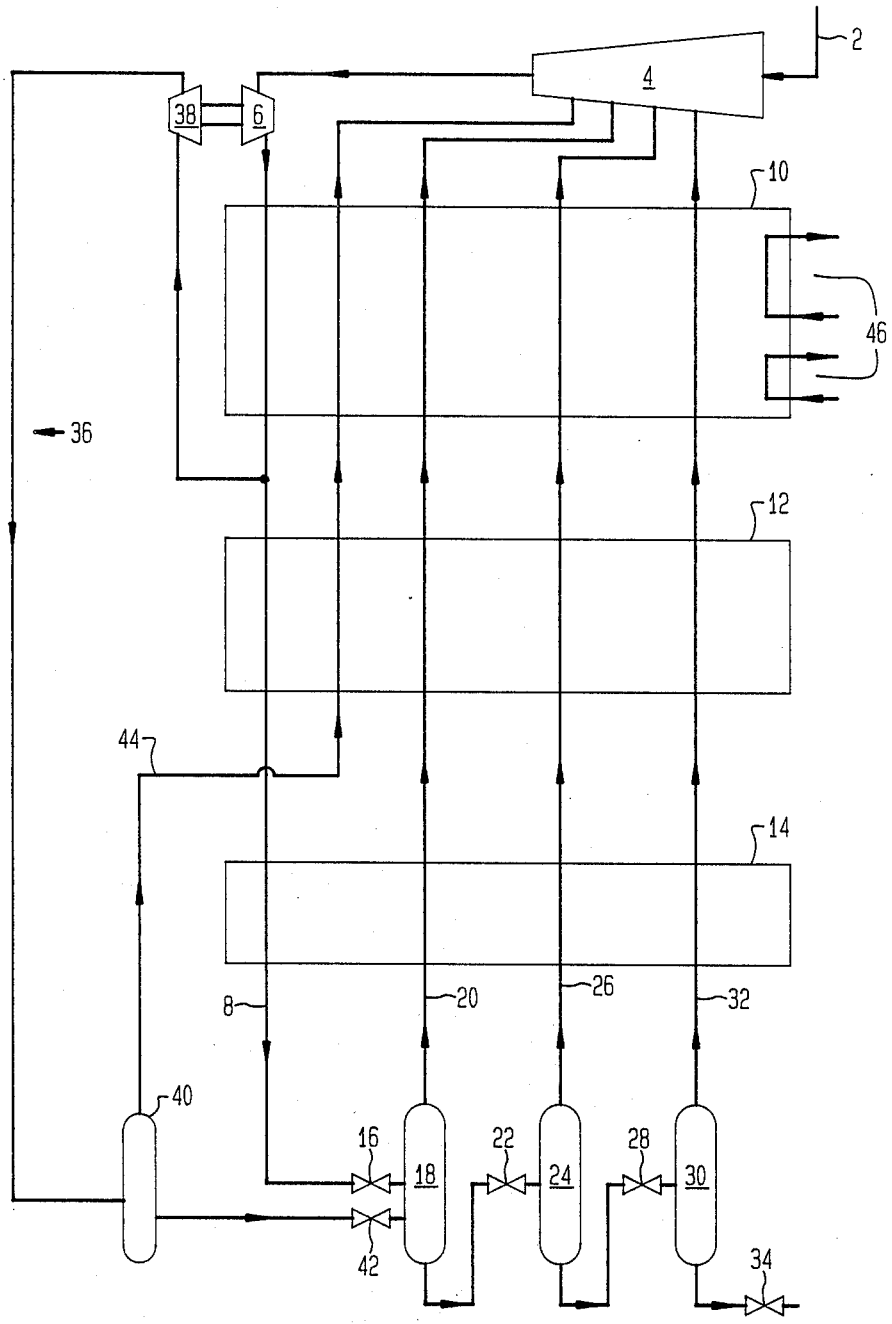

This invention relates to the liquefaction of a permanent gas comprising nitrogen.

Nitrogen is a permanent gas which cannot be liquefied solely by decreasing the temperature of the gas. It is necessary to cool it (at pressure) at least to a "critical temperature", at which the gas can exist in equilibrium with its liquid state.

Conventional processes for liquefying nitrogen or for cooling it to below the critical point typically require the gas to be compressed at ambient temperature to a pressure usually above 30 atmospheres and heat exchanged in one or more heat exchangers against at least one relatively low pressure stream of working fluid. At least some of the working fluid is provided at a temperature below the critical temperature of nitrogen. At least part of the stream of each stream of working fluid is typically formed by compressing working fluid, cooling it in the aforesaid heat exchanger or heat exchangers, and then expanding it with the performance of external work ("work expansion"). The working fluid is preferably taken from the high pressure stream of nitrogen, or this stream may be kept separate from the working fluid, which may nevertheless consist of nitrogen.

In practice, liquid nitrogen is stored or used at a pressure substantially lower than that at which the gaseous nitrogen is taken for isobaric cooling to below its critical temperature. Accordingly, after completing such isobaric cooling, the nitrogen at or below its critical temperature is passed through an expansion or throttling valve whereby the pressure to which it is subjected is substantially reduced, and liquid nitrogen is thus produced together together with a substantial volume of so-called "flash gas". The expansion is substantially isenthalpic and results in the reduction of the temperature of the nitrogen being effected.

Generally, the thermodynamic efficiency of a commercial process for liquefying nitrogen is relatively low and there is ample scope for improving the efficiency. There are a number of prior proposals in the art that teach that nitrogen liquefaction processes with improved efficiency can be achieved by employing a plurality of working fluid cycles, each with its own expansion turbine for work expanding working fluid. See for example U.S. Pat. No. 3 677 019 and UK patent applications 2 145 508A, 2 162 298A and 2 162 299A.

Contrary to the teaching in the art, I have now surprisingly found a particular set of operating conditions that make possible the production of liquid nitrogen at a relatively low specific power consumption and with a reduced heat exchanger duty yet require only one such working fluid cycle. In consequence of the reduced heat exchanger duty and the use of only one working fluid cycle, the capital cost of a liquefier adapted to operate in accordance with the invention is typically lower than known nitrogen liquefiers employing two or more working fluid cycles.

According to the present invention there is provided a method of liquefying a stream of permanent gas comprising nitrogen, including the steps of reducing the temperature of the permanent gas stream at a pressure in the range 75 to 90 atmospheres to below its critical temperature, and performing a single nitrogen working fluid cycle to provide at least part of the refrigeration necessary to reduce the temperature of the permanent gas to below its critical temperature, the nitrogen working fluid cycle comprising compressing the nitrogen working fluid to a pressure in the range 75 to 90 atmospheres, cooling it to a temperature in the range 170 to 200 K, work expanding the cooled nitrogen working fluid to a temperature in the range 107 to 120 K, and warming the work expanded nitrogen working fluid by heat exchange counterCurrently to the said permanent gas stream, refrigeration thereby being provided for the permanent gas stream.

Preferably, the nitrogen working fluid is cooled to a temperature in the range 170 to 185 K and most preferably to a temperature in the range 174 to 180K. The nitrogen working fluid is preferably compressed to the same pressure as the incoming nitrogen gas for liquefaction.

The permanent gas stream downstream of its refrigeration by means of the nitrogen working fluid cycle is preferably subjected to a plurality of and most preferably at least three successive isenthalpic exPansions, the resultant flash gas being separated from the resultant liquid after each isenthalpic expansion. The liquid from each isenthalpic expansion, save the last, is the fluid that is expanded in the immediately succeeding isenthalpic expansion, and at least some (and typically all) of the said flash gas is heat exchanged countercurrently to the Permanent gas streams. Typically, after passing out of heat exchange relationship with the permanent gas stream, the flash gas is recompressed with incoming permanent gas for liquefaction. If desired, the permanent gas stream may downstream of its refrigeration by the said nitrogen working fluid cycle be reduced in pressure by means of one or more expansion turbines, in addition to the fluid isenthalpic expansion stages.

Preferably, the nitrogen working fluid leaves the expansion turbine used to effect its work expansion in saturated state. Typically, the temperature at the outlet of such turbine is in the range 108 to 112 K. Preferably, cooling for the permanent gas stream from ambient temperature to the turbine inlet temperature is provided by suitable mechanical refrigeration means, for example one employing a mixed refrigerant cycle.

In one example of a method according to the invention, the permanent gas stream is nitrogen and is compressed to 80 atmospheres while the nitrogen working fluid is also compressed to 80 atmospheres.

Figure 2:
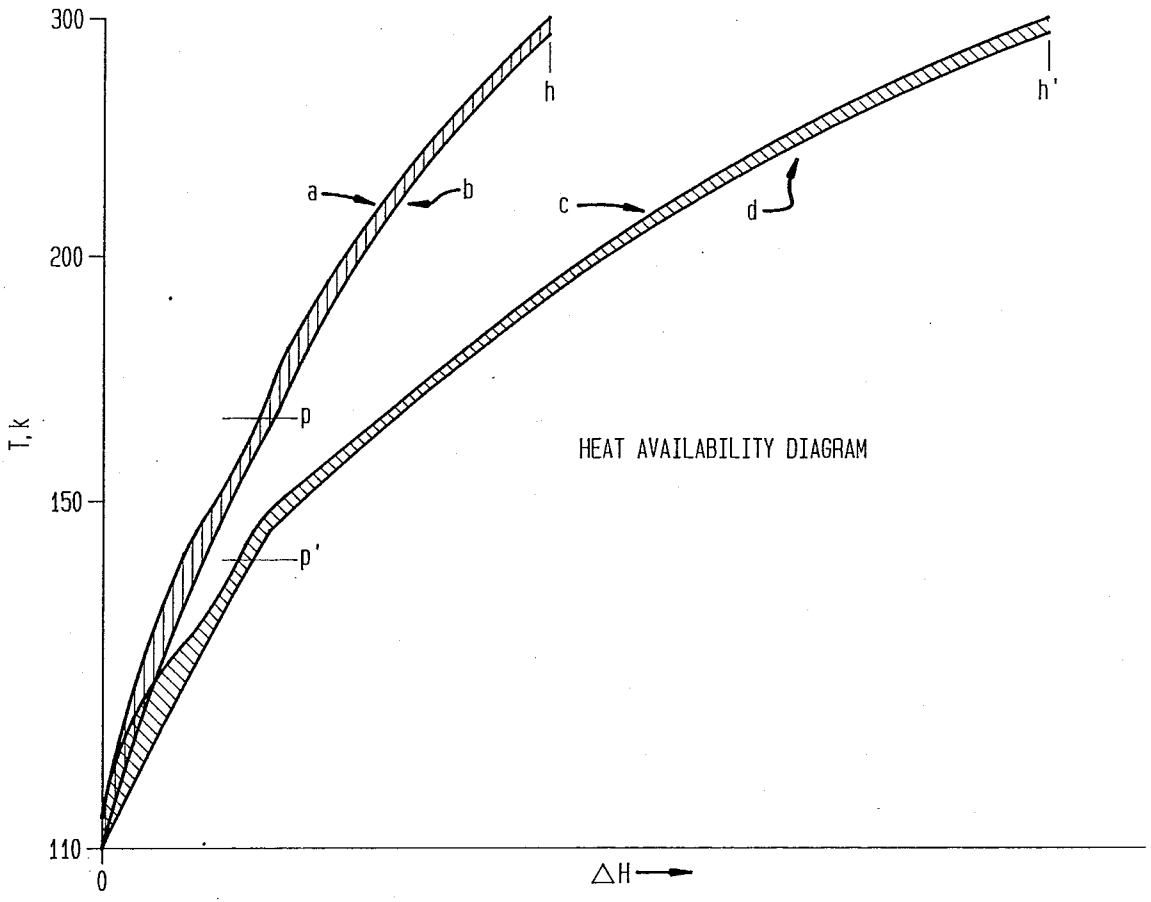

A method according to the invention will now be described by way of example with reference to the accompanying drawings, in which :

FIG. 1 is a schematic flow diagram illustrating a nitrogen liquefier for performing a method according to the invention;

FIG. 2 is a heat availability chart illustrating the match between the temperature-enthalpy profile of the nitrogen stream to be liquefied combined with a nitrogen working fluid stream or streams being cooled by heat exchange in the working fluid cycle and the temperature-enthalpy profile of the returning nitrogen working fluid, being warmed by heat exchange in the working fluid cycle, combined with the returning flash gas.

Returning to FIG. 1 of the drawings, a feed nitrogen stream is passed through an inlet 2 into the lowest pressure stage of a multi-stage compressor 4. As nitrogen flows through the compressor so it is in stages raised in pressure. The main outlet of the compressor 4 is to a booster-compressor 6. The outlet of the booster-compressor 6 communicates with a path 8 leading through heat exchangers 10, 12, and 14 in sequence. The heat exchangers 10, 12 and 14 are effective to cool the nitrogen stream be liquefied to a temperature below the critical temperature of the nitrogen. If desired the heat exchangers 10, 12 and 14 may be formed as a single heat exchange block, and in any case it will generally be desirable to incorporate the heat exchangers 12 and 14 into the same block.

The nitrogen stream leaves the booster-compressor 6 at a pressure in the range 75 to 90 atmospheres absolute and a temperature typically in the order of about 300 K and is reduced in temperature in the first heat exchanger 10 to a temperature in the range 170 to 200 K and preferably in the range 170 to 185 K and more preferably in the range 174 to 180 K. The nitrogen is then cooled in the second heat exchanger 12 to a temperature in the range 110 to 114 K and in the final heat exchanger 14 the nitrogen is subject to a further few degrees of temperature reduction, leaving the heat exchanger at a temperature in the range 106 to 110 K.

After leaving the cold end of the heat exchanger 114, the nitrogen is passed through a throttling or expansion valve 16 in which it is expanded to a pressure below the critical pressure of nitrogen. The resulting mixture of liquid and vapour is passed from the valve 16 to a phase separator 18. The mixture is separated in the separator 18 into a liquid, which is collected therein, and a vapour which is returned through the heat exchangers 14, 12 and 10 in sequence along a path 20 running countercurrently to the path 8. Liquefied gas from the separator 18 is passed through a throttling valve 22 to form a mixture of liquid and flash gas that is passed into a second phase separator 24 in which the mixture is separated into a flash gas and a liquid. The flash gas is returned through the heat exchangers 14, 12 and 10 in sequence along a path 26 running countercurrently to the path 8. Liquid from the separator 24 is passed through another throttling valve 28 and the resulting mixture of liquid and flash gas flows into a third phase separator 30 in which it is separated into flash gas and liquid. The flash gas is returned through the heat exchangers 14, 12 and 10 along a path 32 running countercurrently to the path 8. Liquid is withdrawn from the separator 30 at approximately atmospheric pressure through an outlet valve 34.

Gas flowing along the return paths 20, 26 and 32 after leaving the warm end of the heat exchanger 10 returns to different respective stages of a compressor 4 and is thus reunited with the incoming nitrogen.

It will be seen from FIG. 1 that all the refrigeration for the heat exchanger 14 is provided by the flash gas streams returning along paths 20, 26 and 32. Additional refrigeration for the heat exchangers 10 and 12 is provided by a single nitrogen working fluid cycle 36. In the nitrogen working fluid cycle, a part of the nitrogen gas flowing along the path 8 is taken from a region intermediate the heat exchangers 10 and 12 at a temperature in the range of 170 to 185 K and is passed to the inlet of an expansion turbine 38 in which it is expanded with the performance of external work. The expansion turbine 38 is directly coupled to the booster compressor 6 so that it is able to drive the booster-compressor 6. The nitrogen working fluid leaves the turbine 38 at a temperature in the range 108 to 112 K and at its saturation pressure. The nitrogen working fluid then passes into a guard separator 40 which is able to separate any liquid in the working fluid from its vapour. Such liquid is passed through throttling valve 42 and introduced into the first phase separator 18. The residual vapour is returned through the heat exchangers 12 and 10 in sequence along a path 44 that runs countercurrently to the path 8. The return gas leaves the warm end of the heat exchanger 12 and enters an appropriate stage of the compressor 4 for recompression. It will thus be appreciated that nitrogen working fluid provides refrigeration particularly for the heat exchanger 12 and also for the heat exchanger 10. Additional refrigeration for the heat exchanger 10 is provided by a refrigerant system 46 (for example, a mixed refrigeration system) that is able to cool the incoming nitrogen from its inlet temperature to a temperature in the range 170 to 185 K. Reference is now made to FIG. 2 which depicts the change in enthalpy as a function of temperature of the streams experiencing isobaric heating or cooling in the liquefier heat exchangers. The pair of curves (a) and (b) illustrate operation of the liquefier shown in FIG. 1 of the drawings, while curves (c) and (d) illustrate a liquefier of a known kind employing two working fluid cycles, this liquefier being of the 'series' kind described in our UK patent applications No. 2 162 298A and 2 162 299A, the isobaric cooling and heating taking place at 50 atmospheres.

Curve (a) shows the change in enthalpy with temperature for the stream flows along the path 8. Curve (b) shows the sum of the changes in enthalpy with temperature for all streams which are increasing in temperature. This sum includes the enthalpy change of the working fluid stream returning to the compressor 4 along path 44 and the flash gas streams returning to the compressor 4 along paths 20, 26 and 32. For convenience, a zero level of enthalpy is assigned in FIG. 2 to the point at which the lowest temperature depicted is encountered.

In a similar manner, curve (c) represents the sum of the changes in enthalpy for all streams which are being reduced in temperature in the "series" arrangement of working fluid cycles in the aforesaid known liquefier, and curve (d) represents the sum the changes in enthalpy for all streams in which the temperatures being increased in this series arrangement. The curves of the two respective liquefiers shown in FIG. 2 are drawn to approximate scale and relate to liquefiers with the same rate of output of the liquid nitrogen. The curves differ substantially, in that the curves (c) and (d) for the series arrangement extend from their zero value of enthalpy to a point (h') at 300 K on FIG. 2 representing a substantially greater overall change in enthalpy than the corresponding point (h) which is also located at 300 K for the liquefier according to the invention. The enthalpy values which are the abcissae of points h and h' are, as is well known, the total heat duties of the exchangers represented by FIG. 2. In the liquefier according to the invention, the total heat duty of the exchangers is shown as being substantially less than that in the known series arrangement.

The enthalpy difference at temperatures above 175 K is particularly marked and thus it can be seen that the heat exchange duty of the heat exchanger 10 in the liquefier shown in FIG. 1 is considerably less than the heat exchange duty of the corresponding heat exchanger or exchangers in the known series arrangements. It can also be seen that between pairs of curves (a) and (b) and curves (c) and (d) cross-hatched areas are shown. These areas represent to the scale of the Figure the thermodynamic losses arising from the total heat exchange. It is known in the art that to reduce these losses the sum of the enthalpy changes in the streams in question should be altered so as to bring the curves as close to one another as possible, but not so close that at any point in the exchangers represented by FIG. 2 the temperature difference between the two curves measured on a vertical line is less than a preselected value which is set by the design of the heat exchangers, typically 2 Kelvins or less at a temperature of approximately 150 K. The thermodynamic losses are not only dependent on the temperature differences between the warming and cooling curves on lines of constant enthalpy: they are also dependent on the total enthalpy change that takes place in the nitrogen working fluid being warmed by heat exchange with the Permanent gas stream being cooled since the total area enclosed between each pair of curves is proportional to this enthalpy change. Hence, the invention which makes possible a reduction in the heat duty of the heat exchangers, as discussed above, enables a concomitant reduction in the thermodynamic losses of the liquefier to be achieved.

With regard to the thermodynamic losses arising from heat exchange in the liquefier, in the case of this invention these losses may be reduced to levels not previously obtainable in known commercially operating liquefiers, and, as is well known, lowering the thermodynamic losses leads in turn to a reduction in the sPecific power consumption of the liquefier.

I claim:

1. A method of liquifying a stream of permanent gas comprising nitrogen utilizing a single fluid cycle comprising:

(a) compressing said gas stream to a pressure of from about 75 to 90 atmosphere;

(b) providing a nitrogen working fluid at a pressure of from about 75 to 90 atmospheres;

(c) cooling said fluid to a temperature of from about 170 to 200 K;

(d) work-expanding said fluid toa temperature of from about 107 to 120 K;

(e) warming the work-expanded fluid by heat exchange countercurrently to said gas stream thereby providing refrigeration necessary to reduce the temperature of said gas to below its critical temperature.

2. A method in accordance with claim 1, in which the permanent gas stream is initially cooled to a temperature of from about 170 to 185 K by means of a mixed refrigerant cycle.

3. A method in accordance with claim 1, in which the nitrogen working fluid at the end of work expansion in step (d) is in a saturated state.

4. A method in accordance with claim 3, in which the temperature of the nitrogen working fluid at the end of work expansion in step (d) is from about 108 to 112 K.

5. A method in accordance with claim 1, in which the nitrogen working fluid is compressed to the same pressure as the permanent gas stream.

6. A method as claimed in claim 5, in which said permanent gas stream is subjected to at least three isenthalpic expansions to reduce it in pressure to a storage pressure.

7. A method in accordance with claim 5, wherein the nitrogen working fluid and the permanent gas stream are compressed to a pressure of about 80 atmospheres.

8. A method as claimed in claim 1 in which after passing out of heat exhange relationship with said nitrogen working fluid the said permanent gas stream is expanded to a storage pressure, the resulting liquid being collected and the resulting gas heat exchanged countercurrently to said permanent gas stream.

9. A method in accordance with claim 1, wherein said fluid is withdrawn from said permanent gas stream.

10. A method in accordance with claim 1, including the additional steps of expanding the liquified permanent gas stream to storage pressure thereby forming a liquid fraction and a gaseous fraction, collecting the liquid for storage and passing the gaseous fraction in countercurrent heat exchange to said permanent gas stream.

11. A method in accordance with claim 10, wherein said liquified gas stream is subjected to at least three isenthapic expansions to reduce the pressure thereof to a storage pressure.

* * * * *